US012359843B1

(12) United States Patent
West et al.

(10) Patent No.: US 12,359,843 B1
(45) Date of Patent: Jul. 15, 2025

(54) REMOVABLE ACCESS PANEL FOR HVAC CLOSET

(71) Applicants: Gary West, Mississauga (CA); Elvio De Lima, Mississauga (CA); Henry De Lima, Mississauga (CA)

(72) Inventors: Gary West, Mississauga (CA); Elvio De Lima, Mississauga (CA); Henry De Lima, Mississauga (CA)

( * ) Notice: Subject to any disclaimer, the term of this patent is extended or adjusted under 35 U.S.C. 154(b) by 428 days.

(21) Appl. No.: 17/745,974

(22) Filed: May 17, 2022

(51) Int. Cl.
*F24F 13/28* (2006.01)
*F24F 13/02* (2006.01)
*F24F 13/20* (2006.01)

(52) U.S. Cl.
CPC ..... *F24F 13/20* (2013.01); *F24F 13/029* (2013.01); *F24F 13/28* (2013.01)

(58) Field of Classification Search
CPC ..... F24F 13/20; F24F 13/09; F24F 13/028; B01D 46/10; B01D 46/0005; B01D 2279/50
See application file for complete search history.

(56) References Cited

U.S. PATENT DOCUMENTS 5,186,528 A 2/1993 Schardt
5,679,121 A * 10/1997 Kim ..... B01D 46/10 55/506
6,134,902 A 10/2000 Curry
6,295,826 B1 10/2001 Lee
9,178,337 B2 11/2015 Uselton
9,541,287 B2 1/2017 Ford
2003/0011290 A1* 1/2003 Austin ..... F24F 3/0442 312/326
2005/0279064 A1* 12/2005 Simmons ..... F28F 19/01 55/495
2006/0150463 A1* 7/2006 Kim ..... F24F 13/20 62/331
2015/0082826 A1* 3/2015 Santini ..... F24F 3/044 312/293.3
2016/0084267 A1 3/2016 Showole
2016/0243923 A1* 8/2016 Denninger ..... B01D 46/0006

* cited by examiner

*Primary Examiner* — Frantz F Jules
*Assistant Examiner* — Martha Tadesse
(74) *Attorney, Agent, or Firm* — Kyle A. Fletcher, Esq.

(57) ABSTRACT

The removable access panel for HVAC closet is configured for use with an HVAC system. The removable access panel for HVAC closet forms an access panel that provides access to the interior of the enclosure that contains the HVAC system. The removable access panel for HVAC closet removably attaches to the enclosure that contains the HVAC system. The removable access panel for HVAC closet is a foraminous structure that allows air to flow into and out of the enclosure that contains the HVAC system. The removable access panel for HVAC closet removably comprises a frame structure and a door structure. The door structure controls access into the enclosure that contains the HVAC system. The frame structure removably attaches the door to the enclosure that contains the HVAC system.

18 Claims, 8 Drawing Sheets

REMOVABLE ACCESS PANEL FOR HVAC CLOSET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of central air conditioning (F24F3/00)

Summary of Invention

The removable access panel for HVAC closet is configured for use with an HVAC system. The removable access panel for HVAC closet forms an access panel that provides access to the interior of the enclosure that contains the HVAC system. The removable access panel for HVAC closet removably attaches to the enclosure that contains the HVAC system. The removable access panel for HVAC closet is a foraminous structure that allows air to flow into and out of the enclosure that contains the HVAC system. The removable access panel for HVAC closet removably comprises a frame structure and a door structure. The door structure controls access into the enclosure that contains the HVAC system. The frame structure removably attaches the door to the enclosure that contains the HVAC system.

These together with additional objects, features and advantages of the removable access panel for HVAC closet will be readily apparent to those of ordinary skill in the art upon reading the following detailed description of the presently preferred, but nonetheless illustrative, embodiments when taken in conjunction with the accompanying drawings.

In this respect, before explaining the current embodiments of the removable access panel for HVAC closet in detail, it is to be understood that the removable access panel for HVAC closet is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the removable access panel for HVAC closet.

It is therefore important that the claims be regarded as including such equivalent construction insofar as they do not depart from the spirit and scope of the removable access panel for HVAC closet. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
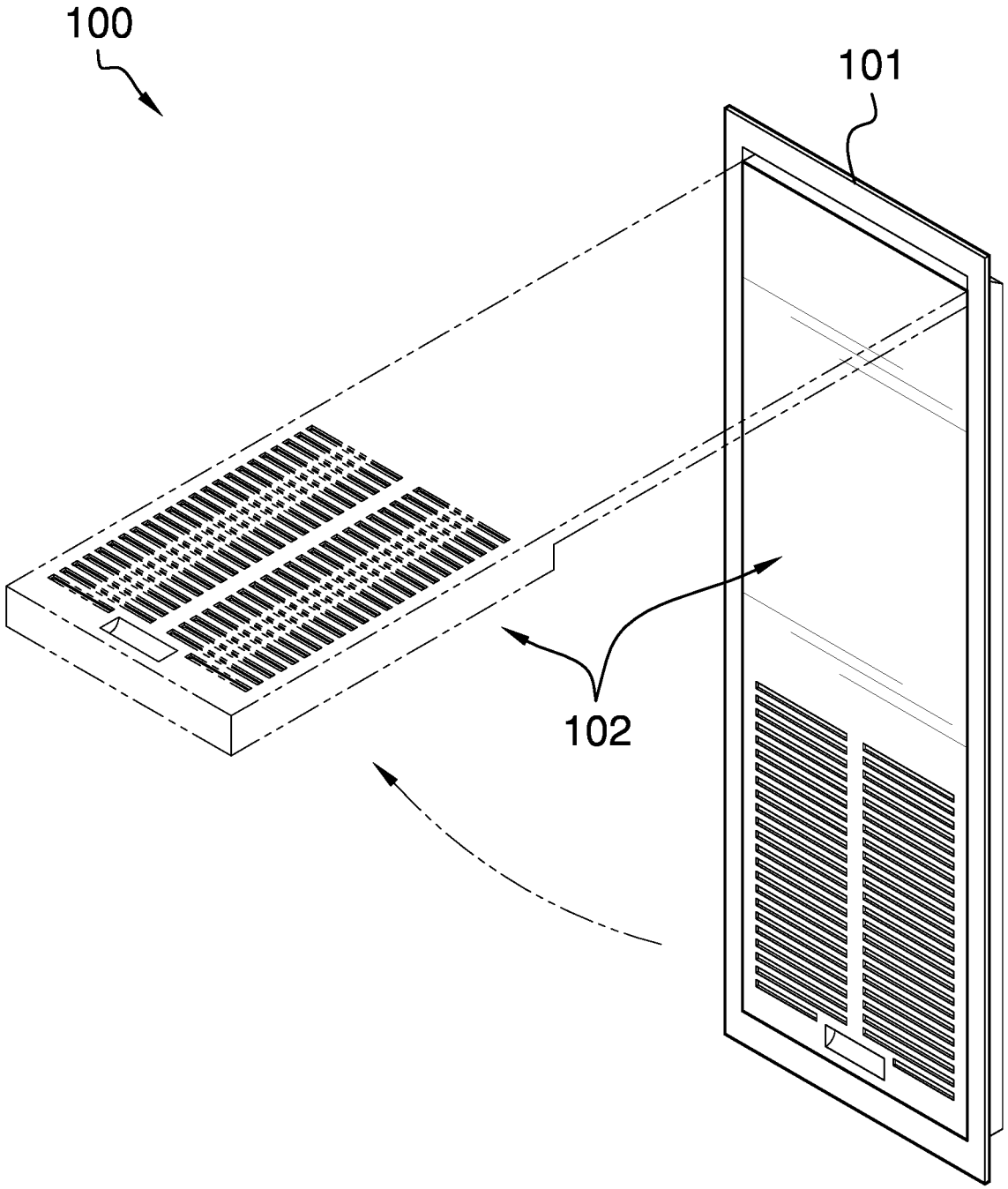
FIG. 1 is a perspective view of an embodiment of the disclosure.
Figure 2:
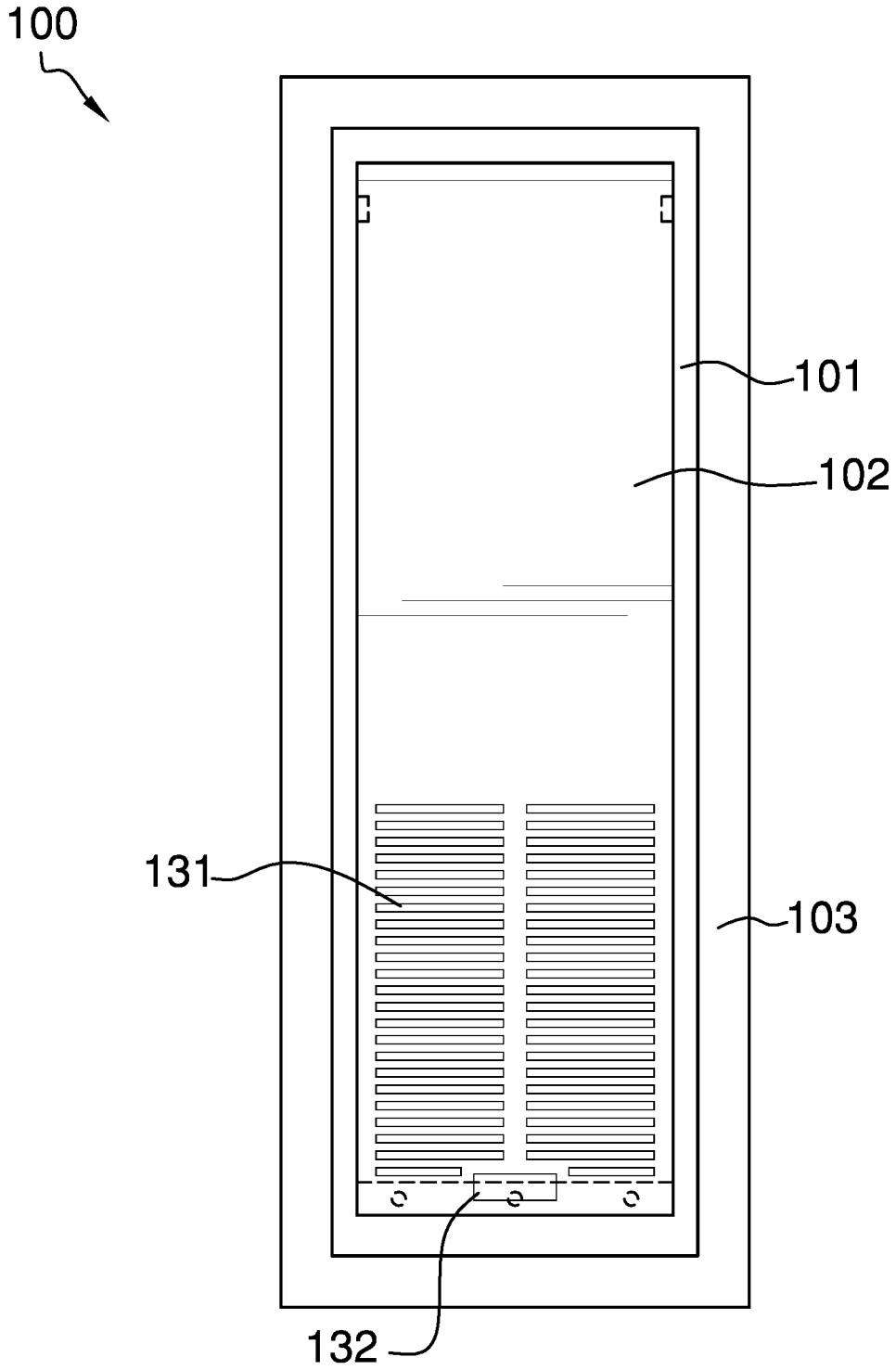
FIG. 2 is a front view of an embodiment of the disclosure.
Figure 3:
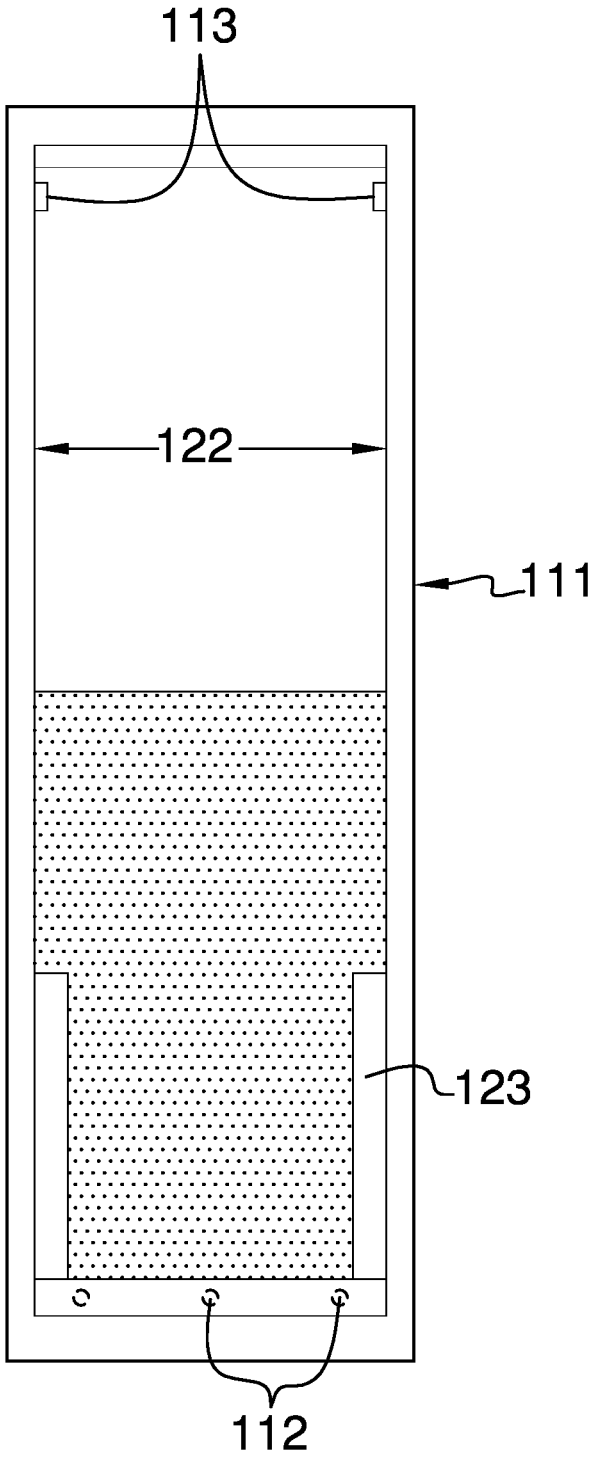
FIG. 3 is a front view of an embodiment of the disclosure.
Figure 4:
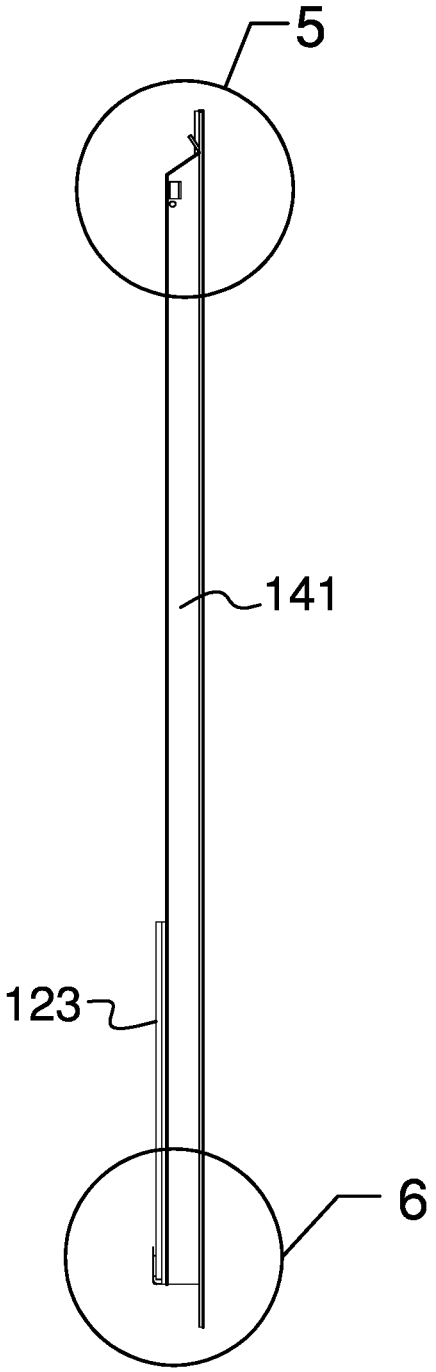
FIG. 4 is a side view of an embodiment of the disclosure.
Figure 5:
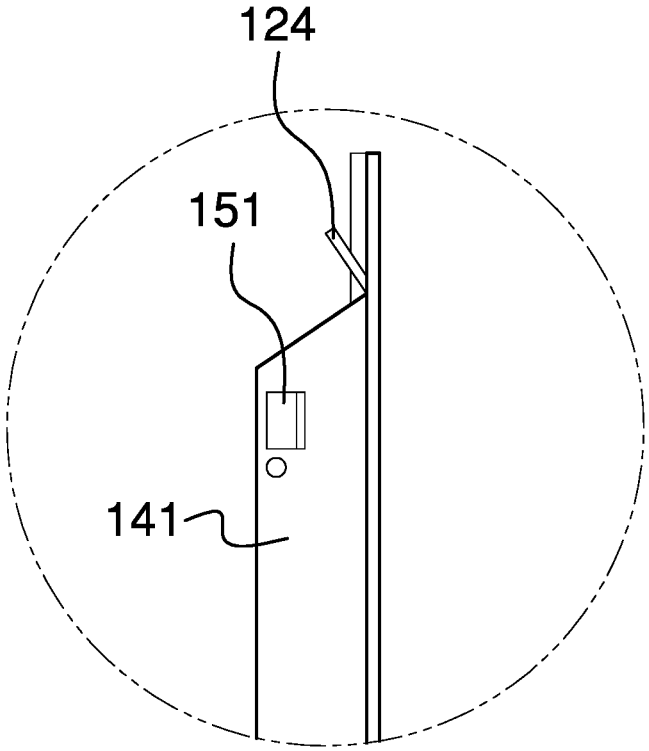
FIG. 5 is a detail view of an embodiment of the disclosure.
Figure 6:
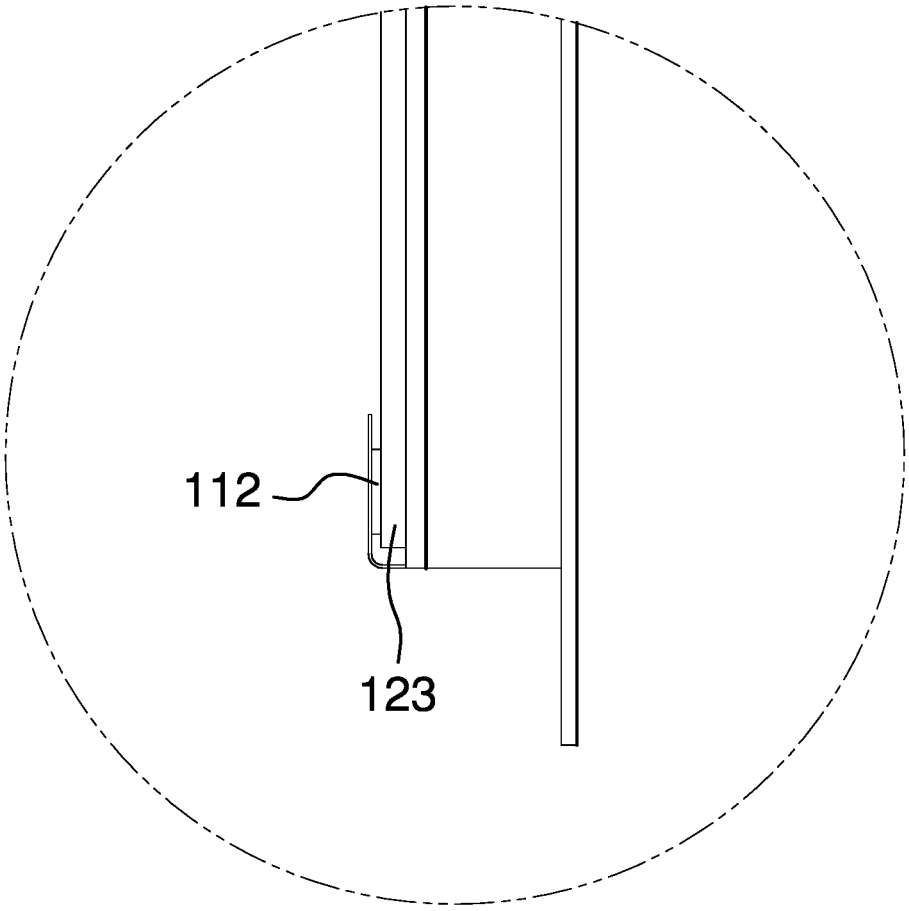
FIG. 6 is a detail view of an embodiment of the disclosure.
Figure 7:
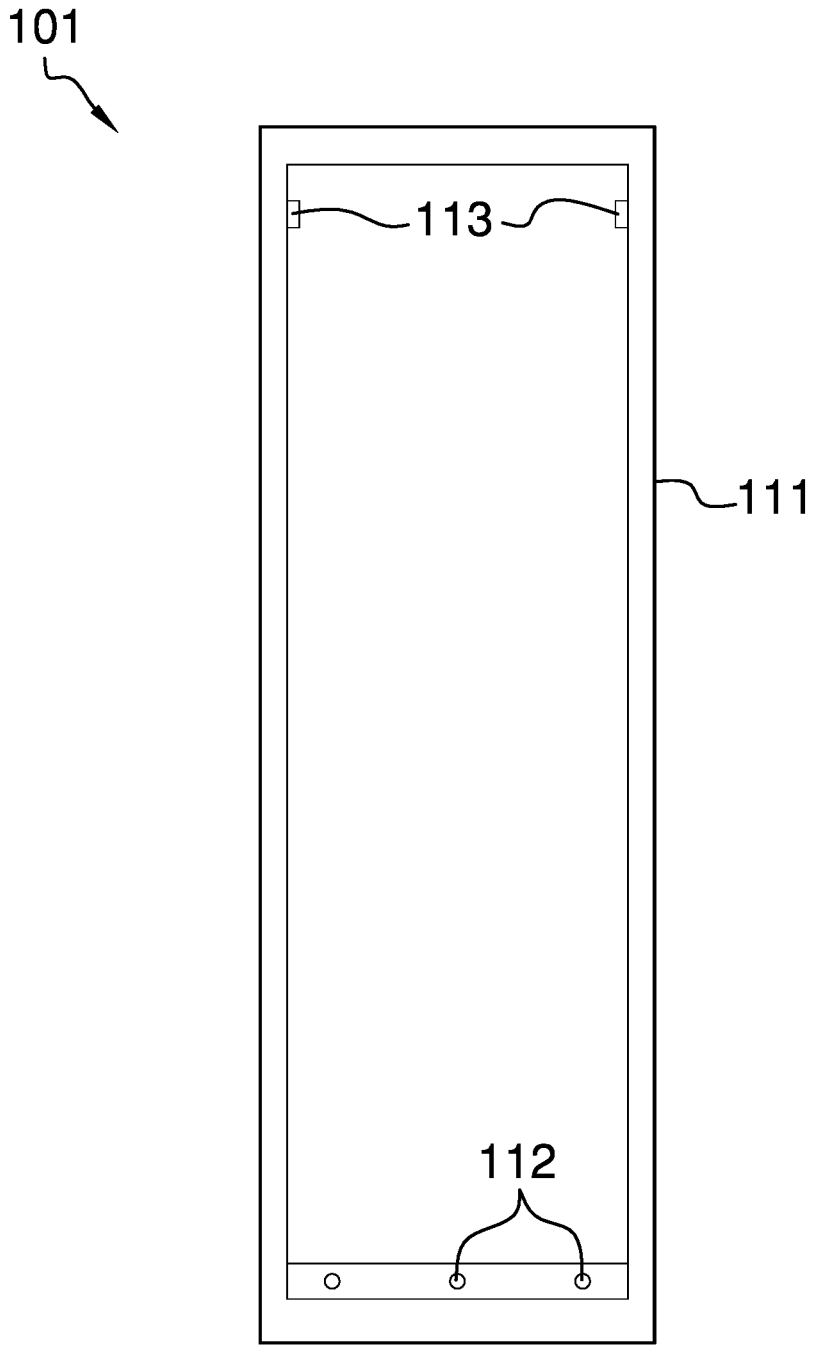
FIG. 7 is a detail view of an embodiment of the disclosure.
Figure 8:
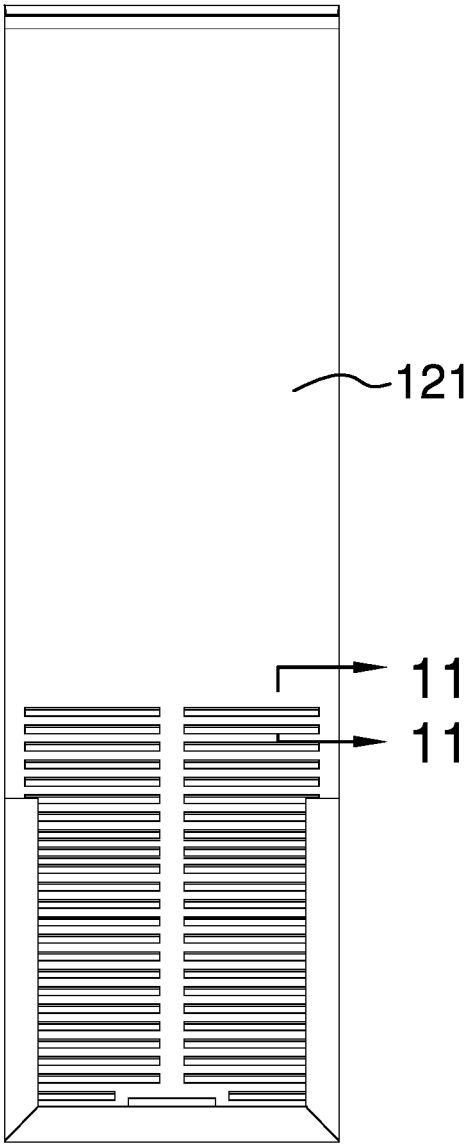
FIG. 8 is a detail view of an embodiment of the disclosure.
Figure 9:
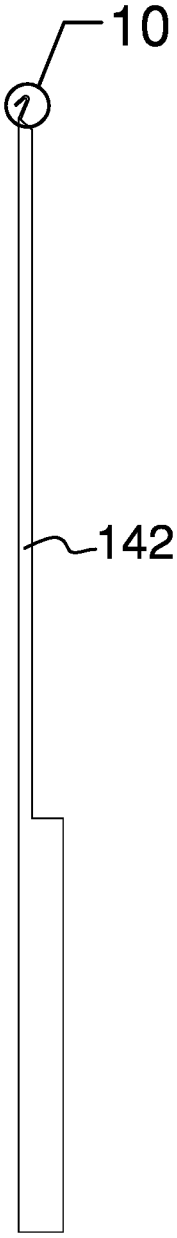
FIG. 9 is a detail view of an embodiment of the disclosure.
Figure 10:
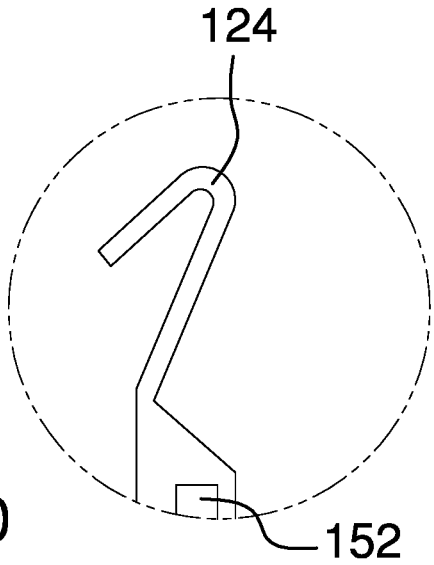
FIG. 10 is a detail view of an embodiment of the disclosure.
Figure 11:
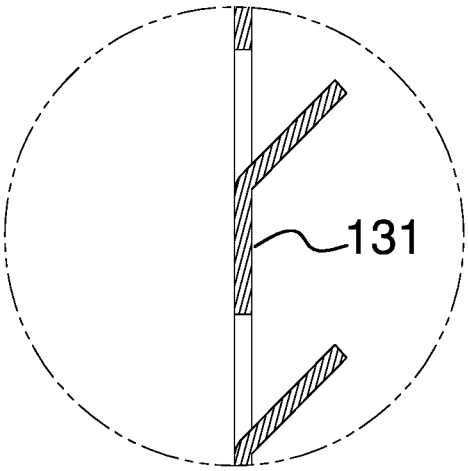
FIG. 11 is a detail view of an embodiment of the disclosure.

Detailed reference will now be made to one or more potential embodiments of the disclosure, which are illustrated in FIGS. 1 through 11.

The removable access panel for HVAC closet 100 (hereinafter invention) is configured for use with an HVAC system. The invention 100 forms an access panel that provides access to the interior of an enclosure 103 that contains the HVAC system. The invention 100 removably attaches to the enclosure 103 that contains the HVAC system. The invention 100 is a foraminous structure that allows air to flow into and out of the enclosure 103 that contains the HVAC system. The invention 100 removably comprises a frame structure 101 and a door structure 102. The door structure 102 controls access into the enclosure 103 that contains the HVAC system. The frame structure 101 removably attaches the door to the enclosure 103 that contains the HVAC system The enclosure 103 is a prism shaped structure. The enclosure 103 has a pan shape. The enclosure 103 forms a containment space that contains equipment associated with an HVAC system. The open face of the pan structure of the enclosure 103 provides access to the equipment associated with the HVAC system. The frame structure 101 removably attaches the door structure 102 to the enclosure 103. The door structure 102 encloses the open face of the pan structure of the enclosure 103.

The frame structure 101 is a mechanical structure. The frame structure 101 is geometrically similar to the open face of the pan structure of the enclosure 103. The frame structure 101 mounts in the open face of the pan structure of the enclosure 103 such that the frame structure 101 encloses the perimeter of the open face of the enclosure 103. The frame structure 101 removably attaches the door structure 102 to the open face of the pan structure of the enclosure 103. The frame structure 101 is a disk shaped structure. The frame structure 101 has a ring structure 111. The negative space characteristic of a ring structure 111 that is formed through the frame structure 101 forms a port that provides access to the containment space of the enclosure 103 that contains the HVAC system. The frame structure 101 comprises a ring structure 111, a plurality of magnets 112, and a plurality of brackets 113.

The ring structure 111 is a mechanical structure. The ring structure 111 is a disk shaped structure. The ring structure 111 has a ring shape. The ring structure 111 forms the structure of the frame structure 101 that physically attaches to the open face of the pan structure of the enclosure 103. The perimeter of the ring structure 111 is geometrically similar to the open face of the pan structure of the enclosure 103 such that the ring structure 111 encloses the perimeter of the open face of the enclosure 103. The ring structure 111 is formed with a magnetic material.

The door structure 102 removably attaches to the ring structure 111. The door structure 102 further attaches to the ring structure 111 such that the door structure 102 rotates relative to the ring structure 111. The door structure 102 is geometrically similar to the negative space characteristic of a ring structure 111 that is formed through the ring structure 111. The door structure 102 fully encloses the negative space characteristic of a ring structure 111 that is formed through the ring structure 111 when the door structure 102 is in the closed position.

Each of the plurality of magnets 112 is a magnet. Each of the plurality of magnets 112 removably attaches to the ring structure 111. Each of the plurality of magnets 112 magnetically attaches to the ring structure 111. Each of the plurality of magnets 112 magnetically attach to the door structure 102 when the door structure 102 is in the closed position. Each of the plurality of magnets 112 secures the door structure 102 to the ring structure 111 when the door structure 102 is in the closed position.

Each of the plurality of brackets 113 is a bracket. Each of the plurality of brackets 113 transfers a portion of the load of the door structure 102 to the ring structure 111. Each of the plurality of brackets 113 removably attaches the door structure 102 to the ring structure 111. Each of the plurality of brackets 113 attaches the door structure 102 to the ring structure 111 such that the door structure 102 rotates relative to the ring structure 111.

The door structure 102 is a mechanical structure. The door structure 102 is a disk shaped structure. The door structure 102 has a pan shape. The door structure 102 is formed as a semi-enclosed pan. The door structure 102 is geometrically similar to the negative space characteristic of a ring structure 111 that is formed through the frame structure 101. The door structure 102 forms a removable barrier that encloses the negative space characteristic of a ring structure 111 that is formed through the frame structure 101.

The door structure 102 fully encloses the negative space characteristic of a ring structure 111 that is formed through the frame structure 101 when the door structure 102 is in the closed position. The door structure 102 is removed from the frame structure 101 when access is required into the containment space of the enclosure 103. The door structure 102 is a fluid permeable structure that allows air to flow through the door structure 102 into and out of the enclosure 103. Optionally, as shown most clearly in FIG. 1, the door structure 102 can rotate towards an open position when access is required into the containment space of the enclosure 103.

The door structure 102 comprises a closed face 121, a plurality of lateral faces 122, a filter frame 123, and a plurality of hooks 124.

The closed face 121 is the closed face 121 of the pan structure of the door structure 102. The closed face 121 forms the surface of the door structure 102 with the greatest surface area. The closed face 121 forms the barrier structure that prevents entry into the open face of the pan structure of the enclosure 103 when the door structure 102 is in the closed position. The closed face 121 comprises a plurality of louvers 131 and a handle 132.

Each of the plurality of louvers 131 is a vent that is formed through the closed face 121 of the door structure 102. Each of the plurality of louvers 131 is fitted with a surface that redirects the direction of the air flowing through the closed face 121 into and out of the enclosure 103. The handle 132 is a grip that is formed in the closed face 121 of the door structure 102. The handle 132 is used to manipulate the door structure 102 within the frame structure 101.

Each of the plurality of lateral faces 122 is a disk shaped structure. Each of the plurality of lateral faces 122 forms a portion of the lateral face of the pan structure of the door structure 102. The plurality of lateral faces 122 comprises a first lateral face 141 and a second lateral face 142.

The first lateral face 141 is the lateral face of the pan structure of the door structure 102 with the greatest span of length. The first lateral face 141 comprises a first bracket clip 151. The first bracket clip 151 is a mechanical structure. The first bracket clip 151 mounts on the first lateral face 141. The first bracket clip 151 removably attaches the first lateral face 141 to a first bracket selected from the plurality of brackets 113. The first bracket clip 151 attaches the first lateral face 141 to the first bracket such that the first lateral face 141 rotates relative to the ring structure 111. The second lateral face 142 is the lateral face of the pan structure of the door structure 102 with the second greatest span of length. The second lateral face 142 is located on the closed face 121 at a position distal from the first lateral face 141 The second lateral face 142 comprises a second bracket clip 152. The second bracket clip 152 is a mechanical structure. The second bracket clip 152 mounts on the second lateral face 142. The second bracket clip 152 removably attaches the second lateral face 142 to a second bracket selected from the plurality of brackets 113. The second bracket clip 152 attaches the second lateral face 142 to the second bracket such that the second lateral face 142 rotates relative to the ring structure 111.

The filter frame 123 is a u-shaped track structure. The filter frame 123 attaches to the interior surface of the closed face 121 of the pan structure of the door structure 102. The filter frame 123 is sized to receive an air filter such that the air filter filters the air that flows through the plurality of louvers 131 of the closed face 121 of the door structure 102. The filter frame 123 is formed from a plurality of c-channels that form the track that receives the air filter.

The plurality of hooks 124 is a fastening structure that attaches the door structure 102 that attaches the ring structure 111. The plurality of hooks 124 suspend the door structure 102 within the ring structure 111. The plurality of hooks 124 allows the door structure 102 to rotate relative to the ring structure 111 into an open position. The plurality of hooks 124 further forms a locking mechanism that allows the door structure 102 to be held in the open position.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bracket: As used in this disclosure, a bracket is a mechanical structure that attaches a second structure to a first structure such that the load path of the second structure is transferred to the first structure.

C-Channel: As used in this disclosure, the C-channel is a structure that is formed in a U-shape. The C-channel forms a prism-shaped negative space with an open lateral face that forms a shape characteristic of the letter C when viewed from the congruent ends. The open space of the C-channel is often used as a track. A C-channel is a U-shaped structure.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Closed Position: As used in this disclosure, a closed position refers to a movable barrier structure that is in an orientation that prevents passage through a port or an aperture. The closed position is often referred to as an object being "closed." Always use orientation.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Door: As used in this disclosure, a door is a movable or removable barrier that is attached to the wall of a room or the surface of a container for the purpose of allowing or preventing access through an aperture into the room or container.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Filter: As used in this disclosure, a filter is a mechanical device that is used to separate solids that are suspended in a liquid or a gas. A strainer is type of filter with what would be considered a coarse mesh measurement.

Form Factor: As used in this disclosure, the term form factor refers to the size and shape of an object.

Force of Gravity: As used in this disclosure, the force of gravity refers to a vector that indicates the direction of the pull of gravity on an object at or near the surface of the earth.

Framework: As used in this disclosure, a framework refers to the substructure of an object that forms the load path for the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

HVAC: As used in this disclosure, HVAC is an acronym for Heating Ventilation and Air Conditioning and is a general term that refers to the air handling technology used within a structure.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Louver: As used in this disclosure, a louver is a (generally rectangular) plate that is installed in a vent for the purpose of directing air flow.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field. A magnet is further defined with a north pole and a south pole. By aligning with an external magnetic field is meant that the north-south pole structure of a first magnet will align with the north south pole of a second magnet. The pole of any first magnet will attract the opposite pole of any second magnet (i.e. a north pole will attract a south pole).

Magnetic Material: As used in this disclosure, a magnetic material is a substance that attracts or is attracted to a magnet but that itself has no net magnetic moment (beyond any residual moment created by prior use). Common classes of magnetic materials include ferromagnetic, diamagnetic, paramagnetic, ferrimagnetic and antiferromagnetic.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Ring: As used in this disclosure, a ring is term that is used to describe a disk-like structure through which a negative space is formed through the faces of the disk-like structure. Rings are often considered loops.

Semi-Enclosed Prism: As used in this disclosure, a semi-enclosed prism is a prism-shaped structure wherein a portion of the lateral face of the prism-shaped is removed or otherwise replaced with a negative space. Always use negative space.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Vent: As used in this disclosure, a vent is an opening in a structure that allows for the flow of gas through the boundary of the structure.

With respect to the above description, it is to be realized that the optimum dimensional relationship for the various components of the invention described above and in FIGS. 1 through 11 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A removable access panel for HVAC enclosure comprising a frame structure and a door structure; wherein the door structure removably attaches to the frame structure; wherein the removable access panel for the HVAC enclosure is configured for use with an HVAC system; wherein the enclosure has a pan shape; wherein the door structure encloses an open face of a pan structure of the enclosure; wherein the frame structure has a ring structure; wherein the ring structure forms the structure of the frame structure that physically attaches to the open face of the pan structure of the enclosure; wherein a perimeter of the ring structure is geometrically similar to the open face of the pan structure of the enclosure such that the ring structure encloses a perimeter of the open face of the enclosure; wherein the ring structure is formed with a magnetic material; wherein the door structure removably attaches to the ring structure; wherein the door structure further attaches to the ring structure such that the door structure rotates relative to the ring structure.

2. The removable access panel for HVAC enclosure according to claim 1 wherein the removable access panel for the HVAC enclosure forms an access panel that provides access to an interior of the HVAC enclosure that contains the HVAC system;

wherein the removable access panel for the HVAC enclosure removably attaches to the enclosure that contains the HVAC system.

3. The removable access panel for HVAC enclosure according to claim 2 wherein the removable access panel for the HVAC enclosure is a foraminous structure that allows air to flow into and out of the HVAC enclosure that contains the HVAC system.

4. The removable access panel for HVAC enclosure according to claim 3 wherein the door structure controls access into the enclosure that contains the HVAC system;

wherein the frame structure removably attaches the door to the enclosure that contains the HVAC system.

5. The removable access panel for HVAC enclosure according to claim 4 wherein the enclosure forms a containment space that contains equipment associated with the HVAC system;

wherein the open face of the pan structure of the enclosure provides access to the equipment associated with the HVAC system;

wherein the frame structure removably attaches the door structure to the enclosure.

6. The removable access panel for HVAC enclosure according to claim 5 wherein the frame structure is a mechanical structure;

wherein the frame structure is geometrically similar to the open face of the pan structure of the enclosure;

wherein the frame structure mounts in the open face of the pan structure of the enclosure such that the frame structure encloses the perimeter of the open face of the enclosure;

wherein the frame structure removably attaches the door structure to the open face of the pan structure of the enclosure.

7. The removable access panel for HVAC enclosure according to claim 6 wherein the frame structure is a disk shaped structure;

wherein a negative space characteristic of a ring structure that is formed through the frame structure forms a port that provides access to the containment space of the enclosure that contains the HVAC system.

8. The removable access panel for HVAC enclosure according to claim 7 wherein the frame structure comprises the ring structure, a plurality of magnets, and a plurality of brackets;

wherein the plurality of magnets and the plurality of brackets attach to the ring structure.

9. The removable access panel for HVAC enclosure according to claim 8 wherein the ring structure is a mechanical structure; wherein the ring structure is a disk shaped structure; wherein the door structure is geometrically similar to the negative space characteristic of the ring structure that is formed through the ring structure; wherein the door structure fully encloses the negative space characteristic of the ring structure that is formed through the ring structure when the door structure is in a closed position.

10. The removable access panel for HVAC enclosure according to claim 9 wherein each of the plurality of magnets is a magnet;

wherein each of the plurality of magnets removably attaches to the ring structure;

wherein each of the plurality of magnets magnetically attaches to the ring structure;

wherein each of the plurality of magnets magnetically attach to the door structure when the door structure is in the closed position;

wherein each of the plurality of magnets secures the door structure to the ring structure when the door structure is in the closed position.

11. The removable access panel for HVAC enclosure according to claim 10 wherein each of the plurality of brackets is a bracket;

wherein each of the plurality of brackets transfers a portion of the load of the door structure to the ring structure;

wherein each of the plurality of brackets removably attaches the door structure to the ring structure;

wherein each of the plurality of brackets attaches the door structure to the ring structure such that the door structure rotates relative to the ring structure.

12. The removable access panel for HVAC enclosure according to claim 11 wherein the door structure is a mechanical structure;

wherein the door structure is a disk shaped structure;

wherein the door structure has a pan shape;

wherein the door structure is formed as a semi-enclosed pan.

13. The removable access panel for HVAC enclosure according to claim 12 wherein the door structure is geometrically similar to the negative space characteristic of the ring structure that is formed through the frame structure; wherein the door structure forms a removable barrier that encloses the negative space characteristic of the ring structure that is formed through the frame structure; wherein the door structure fully encloses the negative space characteristic of the ring structure that is formed through the frame structure when the door structure is in the closed position; wherein the door structure is removed from the frame structure when access is required into the containment space of the enclosure; wherein the door structure is a fluid permeable structure that allows air to flow through the door structure into and out of the enclosure; wherein the door structure comprises the closed position and an open position.

14. The removable access panel for HVAC enclosure according to claim 13 wherein the door structure comprises a closed face, a plurality of lateral faces, a filter frame, and a plurality of hooks;

wherein the plurality of lateral faces, the filter frame, and the plurality of hooks attach to the closed face.

15. The removable access panel for HVAC enclosure according to claim 14 wherein the closed face is the closed face of the pan structure of the door structure; wherein the closed face forms the surface of the door structure with the greatest surface area; wherein the closed face forms a barrier structure that prevents entry into the open face of the pan structure of the enclosure when the door structure is in the closed position; wherein the closed face comprises a plurality of louvers and a handle; wherein each of the plurality of louvers is a vent that is formed through the closed face of the door structure; wherein each of the plurality of louvers is fitted with a surface that redirects the direction of the air flowing through the closed face into and out of the enclosure; wherein the handle is a grip that is formed in the closed face of the door structure; wherein the handle is used to manipulate the door structure within the frame structure; wherein each of the plurality of lateral faces is a disk shaped structure; wherein each of the plurality of lateral faces forms a portion of the lateral face of the pan structure of the door structure.

16. The removable access panel for HVAC enclosure according to claim 15 wherein the plurality of lateral faces comprises a first lateral face and a second lateral face;

wherein the first lateral face is the lateral face of the pan structure of the door structure with the greatest span of length;

wherein the first lateral face comprises a first bracket clip;

wherein the first bracket clip is a mechanical structure;

wherein the first bracket clip mounts on the first lateral face;

wherein the first bracket clip removably attaches the first lateral face to a first bracket selected from the plurality of brackets;

wherein the first bracket clip attaches the first lateral face to the first bracket such that the first lateral face rotates relative to the ring structure;

wherein the second lateral face is the lateral face of the pan structure of the door structure with the second greatest span of length;

wherein the second lateral face is located on the closed face at a position distal from the first lateral face;

wherein the second lateral face comprises a second bracket clip;

wherein the second bracket clip is a mechanical structure;

wherein the second bracket clip mounts on the second lateral face;

wherein the second bracket clip removably attaches the second lateral face to a second bracket selected from the plurality of brackets;

wherein the second bracket clip attaches the second lateral face to the second bracket such that the second lateral face rotates relative to the ring structure.

17. The removable access panel for HVAC enclosure according to claim 16 wherein the filter frame is a u-shaped track structure;

wherein the filter frame attaches to the interior surface of the closed face of the pan structure of the door structure;

wherein the filter frame is sized to receive an air filter such that the air filter filters the air that flows through the plurality of louvers of the closed face of the door structure;

wherein the filter frame is formed from a plurality of c-channels that form the track that receives the air filter.

18. The removable access panel for HVAC enclosure according to claim 17 wherein the plurality of hooks is a fastening structure that attaches the door structure that attaches the ring structure;

wherein the plurality of hooks suspend the door structure within the ring structure;

wherein the plurality of hooks allows the door structure to rotate relative to the ring structure into an open position;

wherein the plurality of hooks further forms a locking mechanism that allows the door structure to be held in the open position.

* * * * *